United States Patent [19]

Carter

[11] 4,133,218

[45] Jan. 9, 1979

[54] CONTROL APPARATUS

[75] Inventor: Carl W. Carter, Peoria, Ill.

[73] Assignee: Caterpillar Tractor Co., Peoria, Ill.

[21] Appl. No.: 827,906

[22] Filed: Aug. 26, 1977

[51] Int. Cl.[2] ..... G05G 9/04; G05G 5/02

[52] U.S. Cl. ..... 74/471 XY; 70/200

[58] Field of Search ..... 74/471 XY; 137/636.2; 70/198, 199, 200, 203

[56] References Cited

U.S. PATENT DOCUMENTS

| | | | |
|---|---|---|---|
| 3,172,300 | 3/1965 | Schneider | 74/471 XY |
| 3,611,826 | 10/1971 | Fisher | 74/471 XY |
| 3,795,152 | 3/1974 | Campbell | 70/200 X |
| 3,811,336 | 5/1974 | Pulskamp | 74/471 XY |
| 4,028,958 | 6/1977 | Schuermann et al. | 137/636.2 X |

FOREIGN PATENT DOCUMENTS

| | | | |
|---|---|---|---|
| 1179322 | 12/1958 | France | 74/471 XY |
| 1434725 | 5/1976 | United Kingdom | 137/636.2 |

*Primary Examiner*—Allan D. Herrmann
*Attorney, Agent, or Firm*—John L. James

[57] ABSTRACT

Control apparatus has first and second assemblies which each have a work element. The work elements are movable between a first position at which the work elements are fully retracted and a second position at which the work elements are fully extended. A single lever mechanism controllably moves the work elements in response to controlled movement of a single lever of the lever mechanism. The lever is pivotally connected to the first assembly and connected to the second assembly and movable therewith.

8 Claims, 7 Drawing Figures

22
II
10
VI
III
40
14
12
VI
28
24
20
30
26
38
II
16
III 10
12
14
16
18
20
22
24
26
28
30
32
33
34
36
38
41
42
43
44
46
52
IV
V 14
12
26
28
24
30
26
18
16

CONTROL APPARATUS

BACKGROUND OF THE INVENTION

Modern machines, such as a track-type loader for example, have multi-positional components, such as a bucket. The bucket is movable vertically and rotationally in response to the manipulation of control levers. One lever typically actuates a hydraulic cylinder which controls only vertical movement of the bucket and another lever actuates a hydraulic cylinder which controls only rotational movement. Separate controls limit the maneuverability of the bucket and occupy valuable machine space. It is desirable to have a single lever control which controls both rotational and vertical movement at the same time and which occupies a minimum amount of machine space. It is also desirable to have a single lever control which is sealed and protected from dirt and contaminants and which can be locked in a nonoperational position.

SUMMARY OF THE INVENTION

The present invention is directed to overcoming one or more of the problems as set forth above.

According to the present invention, control apparatus has first and second assemblies each having a work element. The work elements are movable between a first position at which the work elements are fully retracted and a second position at which the work elements are fully extended. A single lever means controllably moves the work elements in response to controlled movement of a single lever of the lever means. The lever is pivotally connected to the first assembly and movable in a first direction between a first position at which the first work element is fully retracted and a second position at which the first work element is fully extended. The lever is connected to the second assembly and movable therewith in a second direction generally perpendicular to the first direction between a first position at which the second work element is fully retracted and a second position at which the second work element is fully extended.

DETAILED DESCRIPTION

Figure 1:
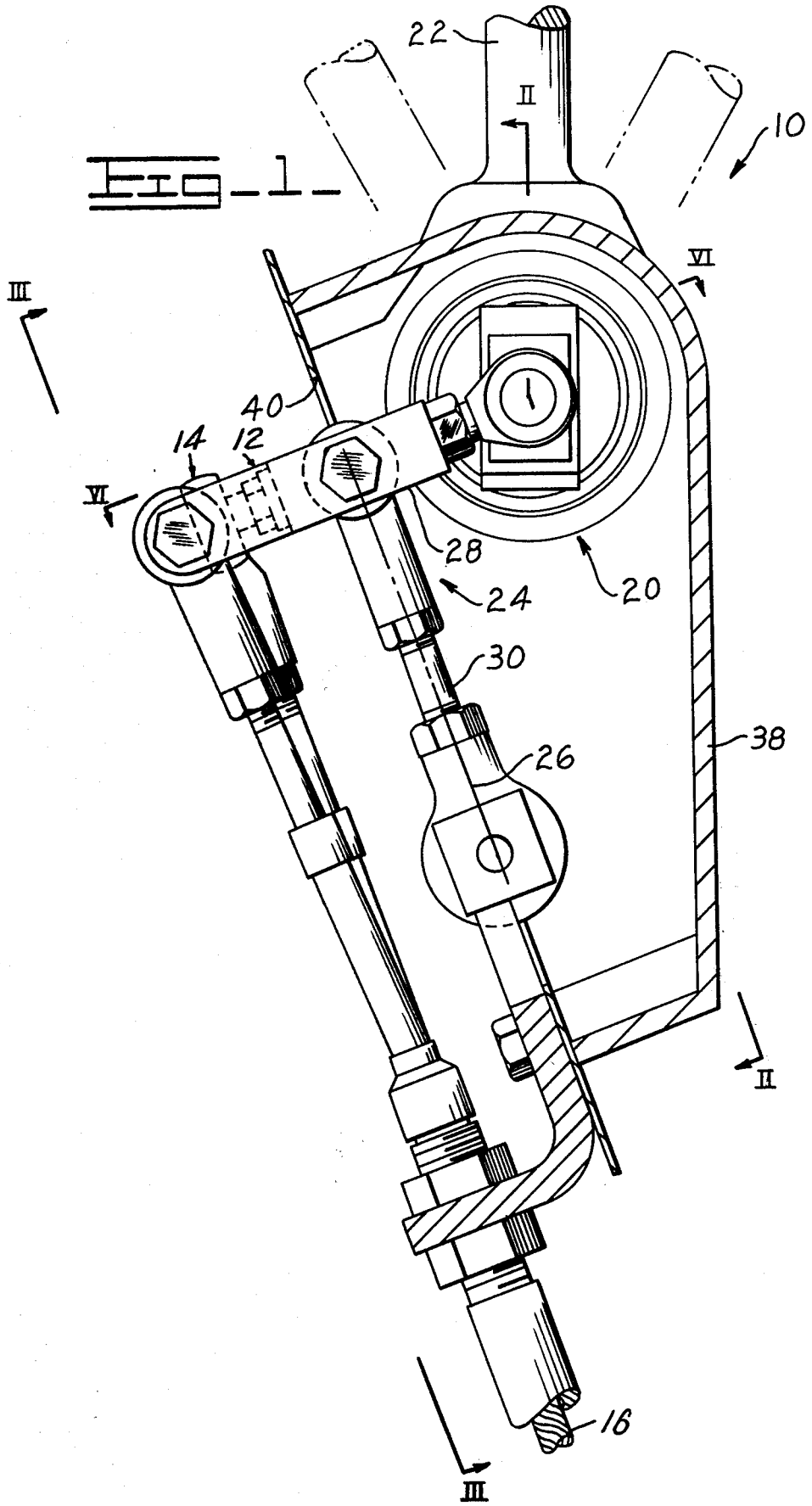
FIG. 1 is a diagrammatic cross-sectional view of the present invention.
Figure 2:
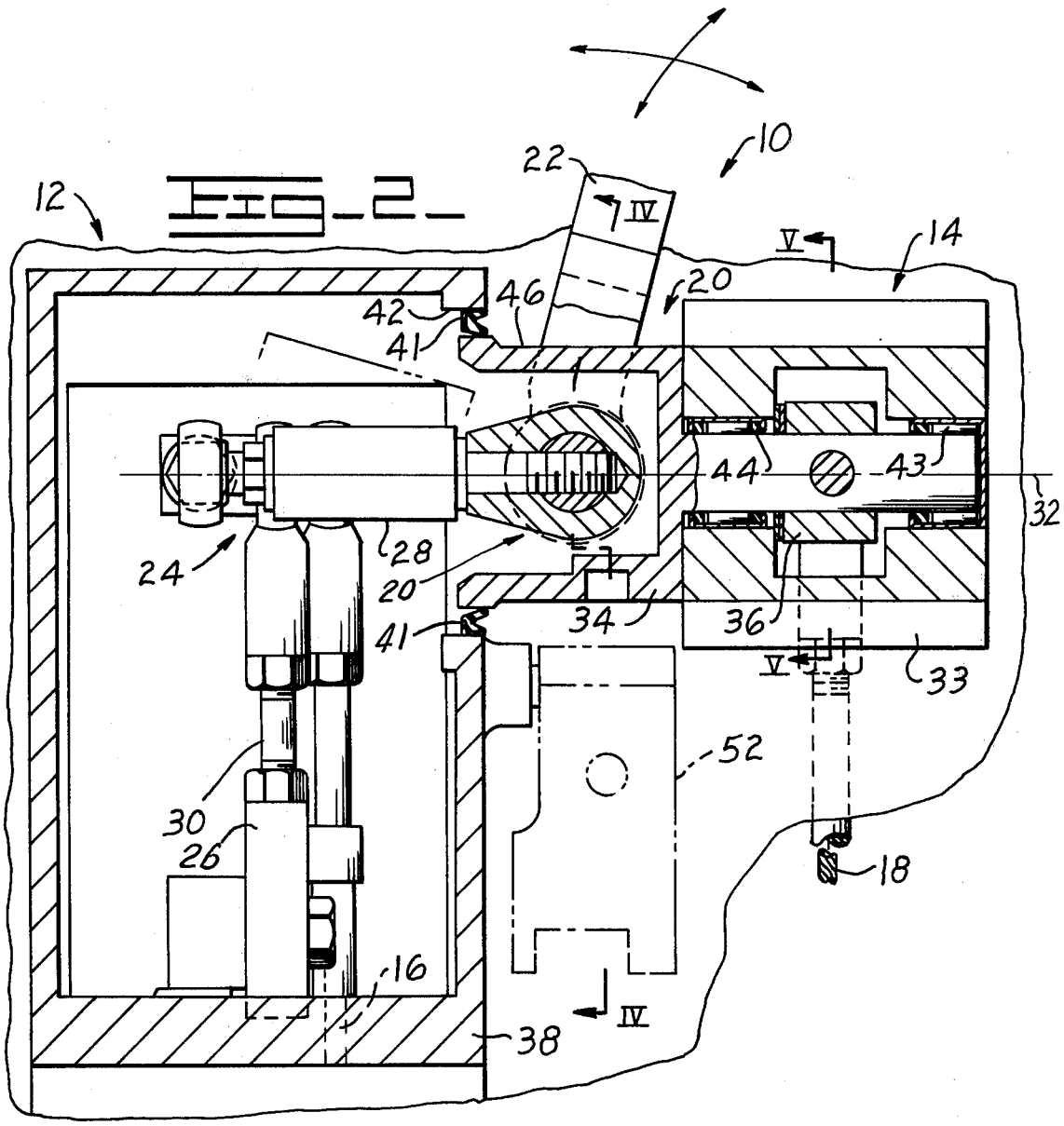
FIG. 2 is a diagrammatic view taken along line II—II of FIG. 1.
Figure 3:
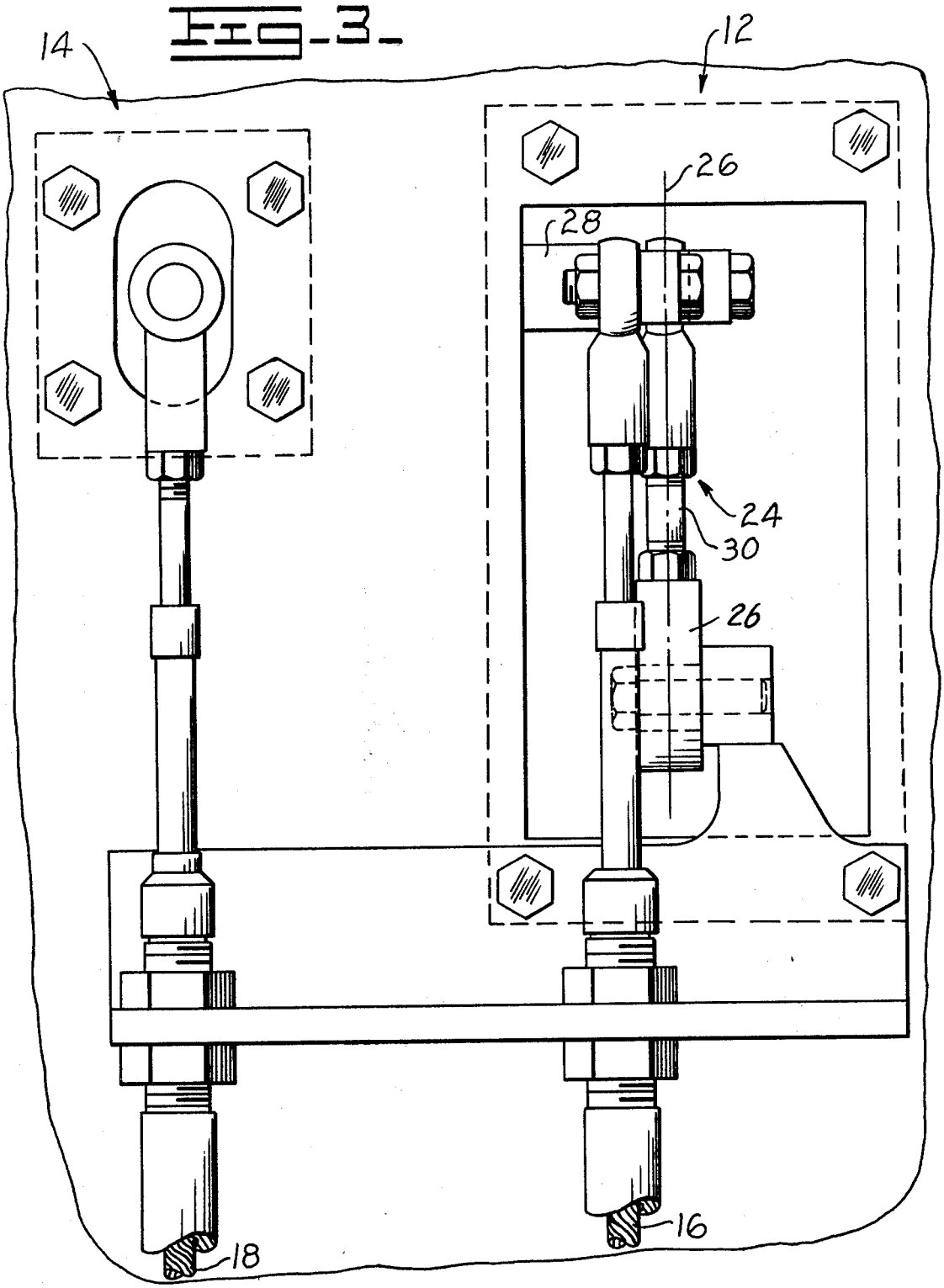
FIG. 3 is a diagrammatic view taken along line III—III of FIG. 1.

Referring to FIGS. 1-3, control apparatus 10 includes first and second assemblies 12, 14 each having a work element 16, 18 respectively. The work elements 16, 18 are movable between a first position at which the work elements 16, 18 are fully retracted and a second position at which the work elements 16, 18 are fully extended (FIG. 3). The work elements 16, 18 preferably control horizontal and rotational movement of a track-type loader bucket by controlling hydraulic circuits.

Figure 4:
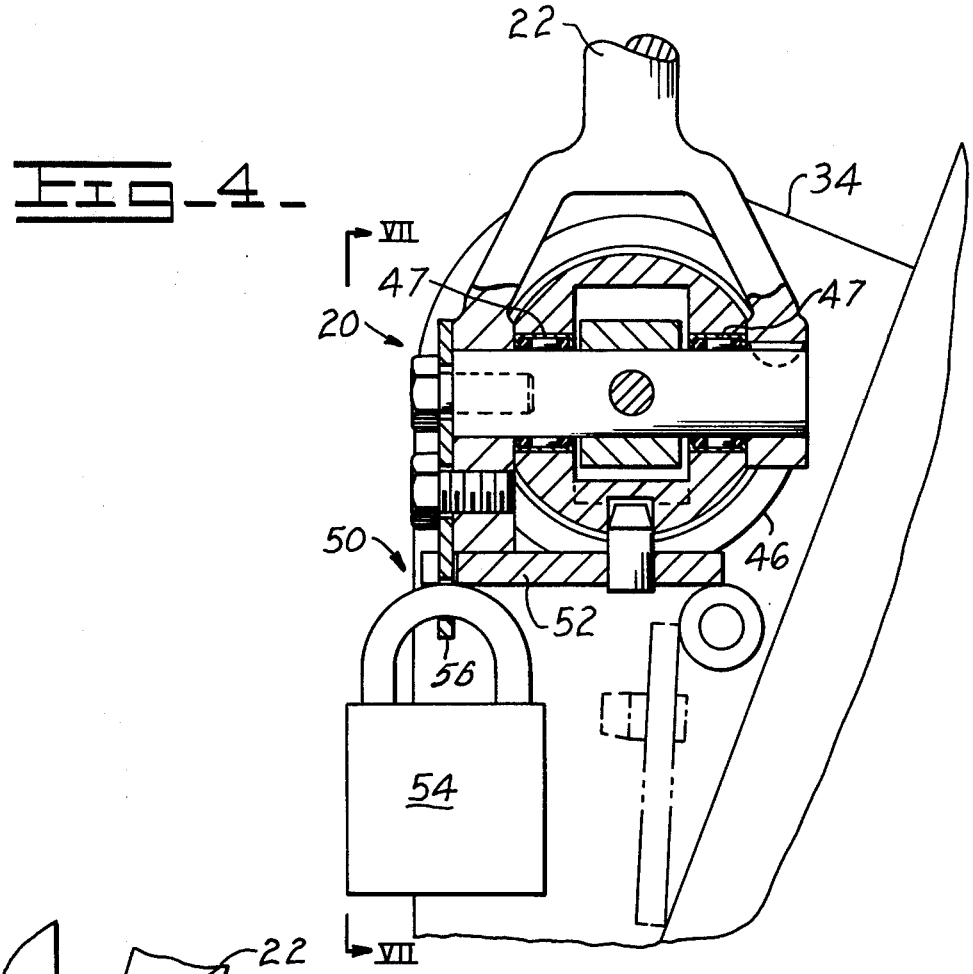
FIG. 4 is a diagrammatic view taken along line IV—IV of FIG. 2.

The control apparatus 10 also includes a single lever means 20 for controllably moving the work elements 16, 18 in response to controlled movement of a single lever 22 of the lever means 20. The lever means 20 pivotally connects the lever 22 and first assembly 12 (FIG. 4).

The lever 22 is movable in a first direction, east-west for example, between a first position at which only the first work element 16 is fully retracted and a second position at which only the first work element 16 is fully extended. The lever 22 is connected to the second assembly 14 and movable therewith in a second direction, north-south for example, generally perpendicular to the first direction first position at which only the second work element 18 is fully retracted and a second position at which only the second work element 18 is fully extended. The lever 22 is movable in both the first and second directions simultaneously. The north-south movement of the lever 22 actuates a hydraulic cylinder which moves the bucket generally vertically, for example, and east-west movement actuates a hydraulic cylinder which moves the bucket pivotally about a fixed point.

Referring to FIGS. 1-3 and 6, the first assembly 12 includes a linkage mechanism 24 connected to the lever means 20 and the first work element 16. The linkage mechanism 24 has an axis 26 and first and second pivotally connected link members 28, 30. The first link 28 is pivotally connected to the lever means 20 by a ball and socket joint and movable in response to movement of the lever 22. The second link 30 is connected by a ball and socket joint to the link member 28 at one end and at the other end to the housing 38. The second link 30 is pivotally movable relative to the axis 26 in response to movement of the first link 28. The second link 30 is preferably adjustable and controls the path of movement of the first link 28.

The first work element 16 is associated with the first link 28 and responsive to movement thereof. The first work element 16 is preferably a cable or rod, such as a push-pull, flexible cable, for example. The work element 16 is preferably connected to a spool of a control valve of a hydraulic circuit which controls bucket movement. The first or second link member 28, 30 can have a construction sufficient for actuating a hydraulic circuit to control bucket movement.

Figure 5:
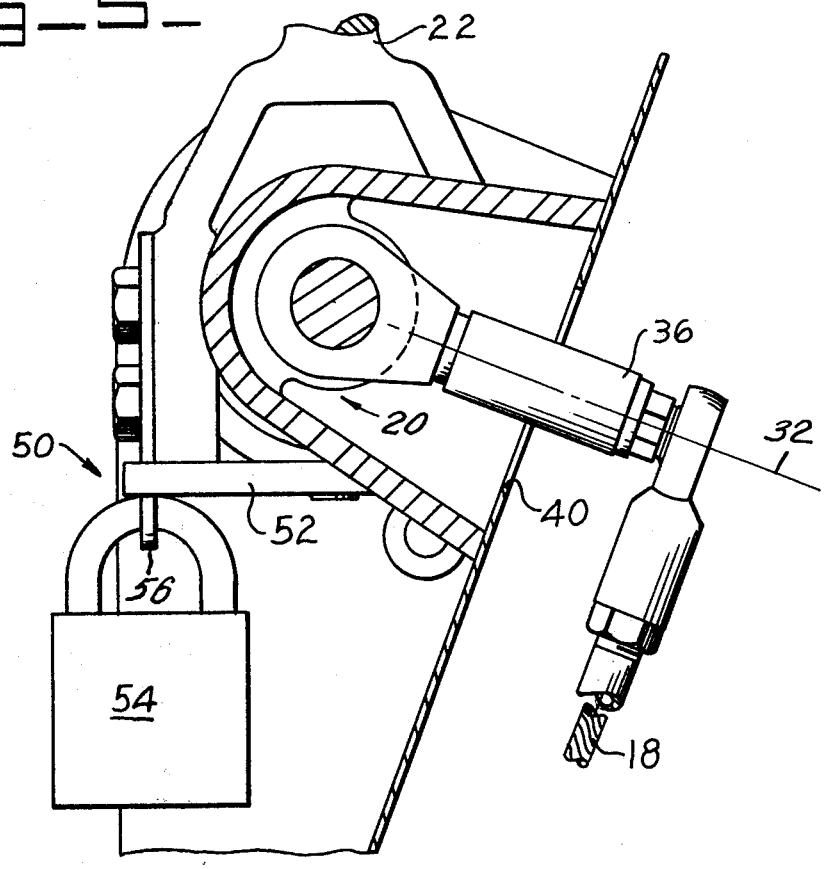
FIG. 5 is a diagrammatic view taken along line V—V of FIG. 2.
Figure 6:
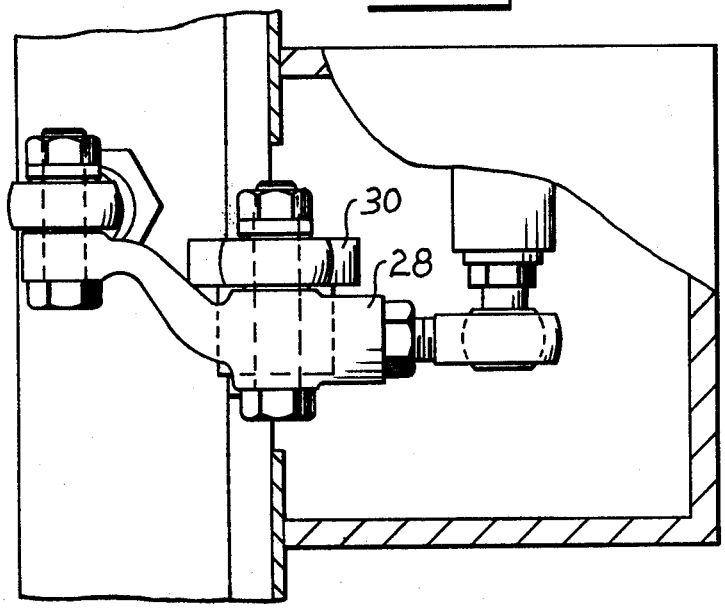
FIG. 6 is a diagrammatic view taken along line VI—VI of FIG. 1.

Referring to FIGS. 2 and 5, the second assembly 14 has an axis 32, a housing 33 and a moving member 34 positioned about the axis 32 and rotatably movable relative to the axis 32 and first assembly 12. The second work element 18 is connected to the moving member 34, preferably by a connecting mechanism 36. The second work element 18 is movable generally perpendicularly relative to the axis 32 in response to the rotatable movement of the moving member 34. The moving member 34 can have a construction sufficient for actuating a circuit to move the bucket.

Referring to FIGS. 1 and 2, the first assembly 12 also includes a housing 38 which is connected to the moving member 34 of the second assembly 14. The first and second assembly housings 38, 33 are preferably fixedly attached to the wheel loader and sealably cover an opening 40 in the wheel loader through which the lever 22 is connected to the work elements 16, 18. The moving member 34 is rotatably movable relative to first assembly 12.

A sealing means, preferably a lip-type rotating shaft seal 41, seals an annulus 42 between the housing 38 and moving member 34 and forms a unitary structure. The lip seal 41 is positioned within the first assembly 12 and positioned about the second assembly 14. The moving member 34 is supported in the second assembly housing 14 by needle bearings 43 which have integral lip-type shaft seals 44. The seals 41, 44 seal out dirt and contaminants and seal in noise.

The moving member 34 has a surface 46 and the lever 22 has a bifurcated end which extends about the surface 46 and is pivotally connected thereto, preferably by sealed bearing joints 47 (FIG. 4). The sealed joint 47 pivotally connects the lever 22 and second assembly 14. The sealed bearing joints 47 prevent the entry of dirt into the moving member 34.

Figure 7:
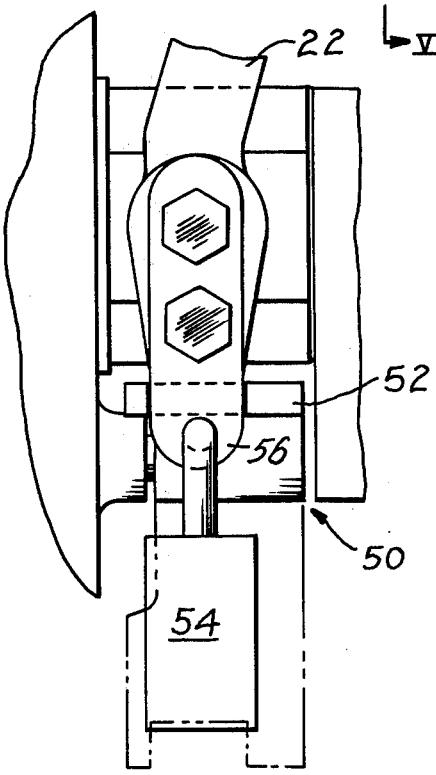
FIG. 7 is a diagrammatic view taken along line VII—VII of FIG. 4.

Referring to FIGS. 4, 5 and 7, a locking means 50 locks the lever 22 in a preselected position. The locking means 50 preferably includes a locking member 52 and a lock 54. The locking member 52 is connected to one of the first and second assemblies 12, 14 and movable between a first position at which the locking member 52 is engaged with the other assembly and the lever means 20 and a second position at which the locking member is free of engagement with the other assembly and the lever means 20. The locking member 52 is preferably pivotally connected to the first assembly 12 and engageable with the lever 22 through flange member 56. The locking member 52 has an opening through which the flange member 56 extends. The lock 54 is inserted in an opening in member 56. The lever 22 is preferably locked in a nonoperational position with the bucket in the down position.

In operation, an operator moves the lever 22 in the first direction and the first work element 16 extends and retracts in response to the movement of the lever 22. The operator moves the lever 22 in the second direction and the second work element 18 extends and retracts. Both of the work elements 16, 18 are extended and retracted at the same time by moving the lever 22 diagonally in both directions. The lip seal 41 keeps out dirt and keeps in noise.

Thus, the control apparatus 10 has a single lever 22 which controls the movement of the two work elements 16, 18. The single lever means 20 and first and second assemblies 12, 14 form a compact, unitary structure. The single lever control is sealed and protected from dirt and contaminants.

Other aspects, objects and advantages will become apparent from a study of the specification, drawings and appended claims.

The embodiments of the invention in which an exclusive property or privilege is claimed are defined as follows:

1. Control apparatus comprising:

first and second assemblies each having a work element, said work elements each being movable between a first position at which said work elements are fully retracted and a second position at which said work elements are fully extended;

a single lever means for controllably moving said work elements in response to controlled movement of a single lever of said lever means, said lever being pivotally connected to said first assembly and movable in a first direction between a first position at which only said first work element is fully retracted and a second position at which only said first work element is fully extended, said lever being connected to said second assembly and movable therewith in a second direction generally perpendicular to the first direction between a first position at which only said second work element is fully retracted and a second position at which only said second work element is fully extended, said lever being movable in the first and second directions simultaneously; and means for locking said lever in a preselected position, said locking means including a locking member connected to one of said first and second assemblies and movable between a first position at which said locking member is engaged with the other of said assemblies and said lever means and a second position at which said locking member is free of engagement with the other said assembly and said lever means.

2. An apparatus, as set forth in claim 1, wherein said first assembly includes first and second link members and an axis, said links being pivotally connected one to the other, said first link being pivotally connected to said lever means and connected to said first work element, said second link being pivotally movable relative to said axis.

3. An apparatus, as set forth in claim 1, including a sealed joint pivotally connecting the lever and second assembly.

4. An apparatus, as set forth in claim 1, wherein said second assembly includes a moving member and an axis, said moving member being positioned about said axis and rotatably movable relative to said axis and said first assembly.

5. An apparatus, as set forth in claim 4, wherein said second work element is connected to said moving member and movable generally perpendicularly relative to said axis in response to the rotatable movement of said moving member.

6. An apparatus, as set forth in claim 4, including a sealed bearing positioned in the second assembly and about the moving member.

7. An apparatus, as set forth in claim 1, including means for sealably connecting said first and second assemblies.

8. An apparatus, as set forth in claim 7, wherein said sealing means includes a lip seal positioned within the first assembly, and positioned about the second assembly.

* * * * *